US007921670B2

(12) United States Patent
Ueno

(10) Patent No.: US 7,921,670 B2
(45) Date of Patent: Apr. 12, 2011

(54) REFRIGERATION APPARATUS

(75) Inventor: Yoshio Ueno, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 142 days.

(21) Appl. No.: 12/517,499

(22) PCT Filed: Dec. 11, 2007

(86) PCT No.: PCT/JP2007/073820
§ 371 (c)(1),
(2), (4) Date: Jun. 3, 2009

(87) PCT Pub. No.: WO2008/072608
PCT Pub. Date: Jun. 19, 2008

(65) Prior Publication Data

US 2010/0011805 A1 Jan. 21, 2010

(30) Foreign Application Priority Data

Dec. 12, 2006 (JP) ..... 2006-334042

(51) Int. Cl.
*F25B 1/00* (2006.01)

(52) U.S. Cl. ..... 62/498; 62/513

(58) Field of Classification Search ..... 62/498, 62/228.3, 129, 126, 208, 238.6, 513; 165/246, 165/247
See application file for complete search history.

(56) References Cited

U.S. PATENT DOCUMENTS

2001/0037653 A1* 11/2001 Yamanaka et al. ..... 62/210
2001/0048031 A1* 12/2001 Noro et al. ..... 237/2 B
2002/0007943 A1* 1/2002 Ozaki et al. ..... 165/202
2002/0078702 A1* 6/2002 Makizono et al. ..... 62/271
2004/0089018 A1* 5/2004 Okaza et al. ..... 62/498
2004/0134217 A1* 7/2004 Itoh et al. ..... 62/324.1
2004/0144528 A1* 7/2004 Kunimoto et al. ..... 165/298
2005/0103487 A1* 5/2005 Aflekt et al. ..... 165/202
2005/0132732 A1* 6/2005 Eisenhower et al. ..... 62/183
2005/0252226 A1* 11/2005 Seefeldt ..... 62/238.7
2005/0274132 A1* 12/2005 Ohta ..... 62/217
2005/0279128 A1* 12/2005 Otake et al. ..... 62/512
2005/0284164 A1* 12/2005 Ohta ..... 62/228.3
2006/0065011 A1* 3/2006 Komatsu et al. ..... 62/468
2006/0107672 A1* 5/2006 Oshitani et al. ..... 62/170
2006/0137387 A1* 6/2006 Aflekt et al. ..... 62/513
2007/0012053 A1* 1/2007 Eisenhower et al. ..... 62/183
2009/0126375 A1* 5/2009 Toyoshima et al. ..... 62/77

FOREIGN PATENT DOCUMENTS

JP 2001-248920 A 9/2001
JP 2004-162945 A 6/2004
JP 3679323 B2 5/2005

* cited by examiner

*Primary Examiner* — Mohammad M Ali
(74) *Attorney, Agent, or Firm* — Global IP Counselors

(57) ABSTRACT

A refrigeration apparatus is configured to perform a refrigeration cycle operation in which a high-pressure side attains a pressure that exceeds the critical pressure of a refrigerant used in the refrigeration cycle operation. The refrigeration apparatus includes a refrigerant circuit and a control unit. The refrigerant circuit has a plurality of constituent components including a compressor, a cooler, an expansion mechanism, and a heater. The control unit is operatively coupled to control at least one of the constituent components such that a quasi-subcooling degree is within a predetermined temperature range, the quasi-subcooling degree being a temperature difference between a quasi-condensation temperature and a cooler outlet refrigerant temperature, with the quasi-condensation temperature being the refrigerant temperature at which isobaric specific heat capacity of the refrigerant at the refrigerant pressure on the high-pressure side of the refrigeration cycle is at a maximum.

4 Claims, 2 Drawing Sheets

REFRIGERATION APPARATUS

CROSS-REFERENCE TO RELATED APPLICATIONS

This U.S. National stage application claims priority under 35 U.S.C. §119(a) to Japanese Patent Application No. 2006-334042, filed in Japan on Dec. 12, 2006, the entire contents of which are hereby incorporated herein by reference.

TECHNICAL FIELD

The present invention relates to a refrigeration apparatus, and particularly relates to a refrigeration apparatus that performs a refrigeration cycle operation in which the high-pressure side attains a pressure that exceeds the critical pressure of the refrigerant.

BACKGROUND ART

In the air conditioning apparatus as a type of refrigeration apparatus, the use of a natural refrigerant that has minimal effect on the environment as the refrigerant charged in the refrigerant circuit has recently been studied. When carbon dioxide or another refrigerant having a low critical temperature is used as the natural refrigerant, a refrigeration cycle operation is performed in which the refrigerant pressure on the high-pressure side exceeds the critical pressure of the refrigerant.

A technique is known for enabling high operating efficiency in an air conditioning apparatus that performs a refrigeration cycle operation in which the high-pressure side attains a pressure that exceeds the critical pressure of the refrigerant. In this technique, the refrigerant pressure range on the high-pressure side whose coefficient of performance is near maximum is prescribed as the set value of the refrigerant pressure on the high-pressure side with respect to the refrigerant temperature at the outlet of a cooler, and the degree of opening or the like of a pressure reducing means is controlled so that the refrigerant pressure on the high-pressure side conforms to the set value (see Japanese Patent No. 3679323).

DISCLOSURE OF THE INVENTION

However, when the degree of opening or the like of the pressure reducing means is controlled so that the refrigerant pressure on the high-pressure side conforms to the set value in the control method described above for controlling the refrigerant pressure on the high-pressure side, the refrigerant temperature at the outlet of the cooler changes, and this change is accompanied by a change in the refrigerant pressure range on the high-pressure side where the coefficient of performance is near maximum. The degree of opening or the like of the pressure reducing means must therefore be repeatedly controlled so that the refrigerant pressure reaches the set value of the refrigerant pressure on the high-pressure side after the change in the refrigerant temperature at the outlet of the cooler. In the conventional method for controlling the refrigerant pressure on the high-pressure side, since the set value of the refrigerant pressure on the high-pressure side is changed by control of the degree of opening or the like of the pressure reducing means, it takes time for the coefficient of performance to approach the maximum value.

An object of the present invention is to enable high-efficiency operation to be rapidly achieved in a refrigeration apparatus that performs a refrigeration cycle operation in which the high-pressure side attains a pressure that exceeds the critical temperature of the refrigerant.

A refrigeration apparatus according to a first aspect of the present invention is a refrigeration apparatus for performing a refrigeration cycle operation in which a high-pressure side attains a pressure that exceeds the critical pressure of a refrigerant, the refrigeration apparatus having a refrigerant circuit that includes a compressor, a cooler, an expansion mechanism, and a heater, wherein a constituent component is controlled so that a quasi-subcooling degree, which is the temperature difference between a quasi-condensation temperature and a cooler outlet refrigerant temperature, is within a predetermined temperature range, the quasi-condensation temperature being the refrigerant temperature at which the isobaric specific heat capacity of the refrigerant at the refrigerant pressure on the high-pressure side of the refrigeration cycle is at a maximum.

The inventors discovered a correlation between the coefficient of performance and the quasi-subcooling degree. A control method is therefore employed in the refrigeration apparatus for using such information to control the quasi-subcooling degree as a controlled variable so as to have a value within a predetermined temperature range.

The convergence of control can thereby be enhanced in comparison to the conventional control method in which the refrigerant pressure on the high-pressure side with respect to the cooler outlet refrigerant temperature is controlled so as to conform to a set value. High-efficiency operation can therefore be rapidly achieved when the predetermined temperature range of the quasi-subcooling degree is set to a temperature range in which the coefficient of performance is near maximum.

A refrigeration apparatus according to a second aspect of the present invention is the refrigeration apparatus according to the first aspect of the present invention, wherein the predetermined temperature range is set within a temperature range of 5° C. to 12° C.

The inventors discovered that the coefficient of performance is near maximum when the quasi-subcooling degree is within a temperature range of 5° C. to 12° C. Such information is therefore used to achieve high-efficiency operation in which the coefficient of performance is near maximum in the refrigeration apparatus by setting the predetermined temperature range of the quasi-subcooling degree to within the temperature range of 5° C. to 12° C.

A refrigeration apparatus according to a third aspect of the present invention is the refrigeration apparatus according to the first or second aspect of the present invention, wherein the expansion mechanism is used as the constituent component.

Using the expansion mechanism to control the value of the quasi-subcooling degree to within the predetermined temperature range gives the refrigeration apparatus satisfactory responsiveness of control.

DETAILED DESCRIPTION THE INVENTION

An embodiment of the refrigeration apparatus of the present invention will be described hereinafter based on the drawings.

(1) Structure of Air Conditioning Apparatus

Figure 1:
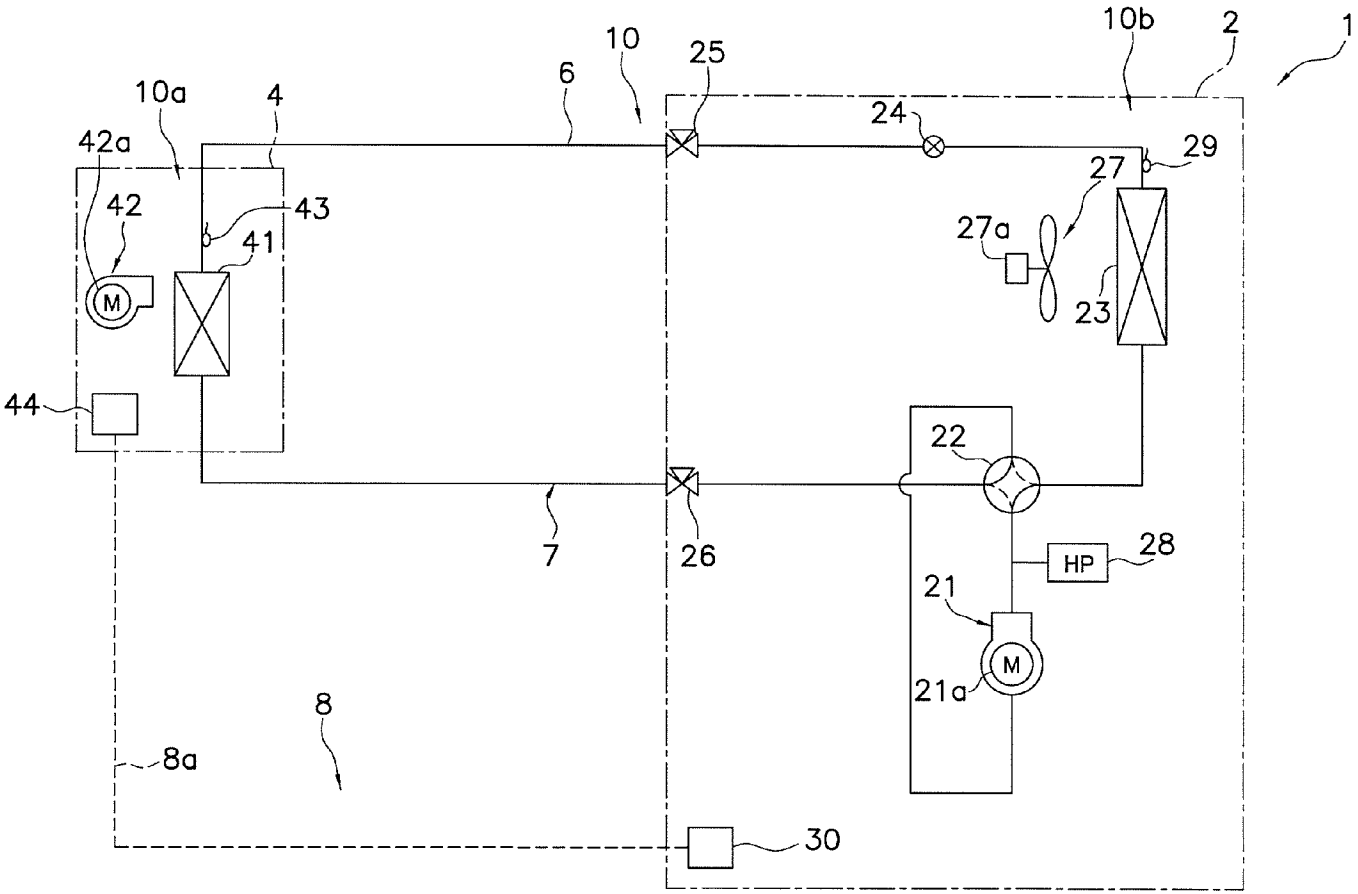
FIG. 1 is a schematic configuration diagram showing an air conditioning apparatus as an embodiment of the refrigeration apparatus of the present invention.

FIG. 1 is a schematic configuration diagram showing an air conditioning apparatus 1 as an embodiment of the refrigeration apparatus of the present invention. The air conditioning apparatus 1 is a apparatus used for indoor cooling and heating by performing a vapor-compression refrigeration cycle operation. The air conditioning apparatus 1 in the present embodiment is provided with a heat source unit 2, a utilization unit 4, and a first refrigerant communication pipe 6 and a second refrigerant communication pipe 7 as refrigerant communication pipes for connecting the heat source unit 2 and the utilization unit 4. Specifically, the vapor-compression refrigerant circuit 10 of the air conditioning apparatus 1 of the present embodiment is configured by the connection between the heat source unit 2, the utilization unit 4, and the refrigerant communication pipes 6, 7. Carbon dioxide as the refrigerant is charged into the refrigerant circuit 10, and as described hereinafter, a refrigeration cycle operation is performed in which the refrigerant is compressed to a pressure that exceeds the critical pressure of the refrigerant, and the refrigerant is cooled, reduced in pressure, and heated/evaporated, and then re-compressed.

<Utilization Unit>

The utilization unit 4 is installed inside a room or the like and connected to the heat source unit 2 via the refrigerant communication pipes 6, 7, and constitutes a portion of the refrigerant circuit 10.

The structure of the utilization unit 4 will next be described. The utilization unit 4 primarily has a utilization-side refrigerant circuit 10*a* that constitutes a portion of the refrigerant circuit 10. The utilization-side refrigerant circuit 10*a* primarily has a utilization-side heat exchanger 41.

The utilization-side heat exchanger 41 is a heat exchanger that functions as a heater or a cooler of the refrigerant. One end of the utilization-side heat exchanger 41 is connected to the first refrigerant communication pipe 6, and the other end is connected to the second refrigerant communication pipe 7.

The utilization unit 4 in the present embodiment is provided with a utilization-side fan 42 for sucking indoor air into the unit and supplying the air back into the room, and is capable of exchanging heat between the indoor air and the refrigerant that flows through the utilization-side heat exchanger 41. The utilization-side fan 42 is rotationally driven by a utilization-side fan driving motor 42*a*.

Various types of sensors are provided to the utilization unit 4. Specifically, a utilization-side heat exchanger temperature sensor 43 for detecting a cooler outlet refrigerant temperature Tco is provided to the outlet of the utilization-side heat exchanger 41 in a case in which the utilization-side heat exchanger 41 is made to function as a cooler of the refrigerant. In the present embodiment, the utilization-side heat exchanger temperature sensor 43 is composed of a thermistor. The utilization unit 4 also has a utilization-side control unit 44 for controlling the operation of the constituent components that constitute the utilization unit 4. The utilization-side control unit 44 has a microcomputer, memory, and other components provided in order to control the utilization unit 4, and is configured so as to be able to exchange control signals and the like with a remote controller (not shown) for separately operating the utilization unit 4, and exchange control signals and the like with the heat source unit 2 via a transmission line 8*a*.

<Heat Source Unit>

The heat source unit 2 is installed outside the room or elsewhere, is connected to the utilization unit 4 via the refrigerant communication pipes 6, 7, and forms the refrigerant circuit 10 with the utilization unit 4.

The structure of the heat source unit 2 will next be described. The heat source unit 2 primarily has a heat-source-side refrigeration circuit 10*b* that constitutes a portion of the refrigerant circuit 10. The heat-source-side refrigeration circuit 10*b* primarily has a compressor 21, a switching mechanism 22, a heat-source-side heat exchanger 23, a heat-source-side expansion mechanism 24, a first closing valve 25, and a second closing valve 26.

The compressor 21 in the present embodiment is a sealed compressor that is driven by a compressor driving motor 21*a*.

The switching mechanism 22 is a mechanism for switching the flow direction of refrigerant in the refrigerant circuit 10. During cooling, the switching mechanism 22 is capable of connecting the discharge side of the compressor 21 and one end of the heat-source-side heat exchanger 23, and connecting the second closing valve 26 and the intake side of the compressor 21 (see the solid line of the switching mechanism 22 in FIG. 1) in order to cause the heat-source-side heat exchanger 23 to function as a cooler of the refrigerant compressed by the compressor 21, and to cause the utilization-side heat exchanger 41 to function as a heater of the refrigerant cooled in the heat-source-side heat exchanger 23. During heating, the switching mechanism 22 is capable of connecting the second closing valve 26 and the discharge side of the compressor 21, and connecting the intake side of the compressor 21 and one end of the heat-source-side heat exchanger 23 (see the dashed line of the switching mechanism 22 in FIG. 1) in order to cause the utilization-side heat exchanger 41 to function as a cooler of the refrigerant compressed by the compressor 21, and to cause the heat-source-side heat exchanger 23 to function as a heater of the refrigerant cooled in the utilization-side heat exchanger 41. In the present embodiment, the switching mechanism 22 is a four-way switch valve that is connected to the intake side of the compressor 21, the discharge side of the compressor 21, the heat-source-side heat exchanger 23 and the second closing valve 26. Note that, the switching mechanism 22 is not limited to a four-way switch valve, and may be configured so as to be capable of switching the direction of refrigerant flow in the same manner as described above by employing a configuration such as combining a plurality of magnetic valves, for example.

The heat-source-side heat exchanger 23 is a heat exchanger for functioning as a cooler or a heater of the refrigerant. One end of the heat-source-side heat exchanger 23 is connected to the switching mechanism 22, and the other end is connected to the heat-source-side expansion mechanism 24.

The heat source unit 2 has a heat-source-side fan 27 for sucking outside air into the unit and exhausting air back to the outside. The heat-source-side fan 27 is capable of exchanging heat between the outside air and the refrigerant that flows through the heat-source-side heat exchanger 23. The heat-source-side fan 27 is rotationally driven by a heat-source-side fan driving motor 27*a*. The heat source of the heat-source-side heat exchanger 23 is not limited to outside air and may be water or another heat medium.

The heat-source-side expansion mechanism 24 is a mechanism for reducing the pressure of the refrigerant, and in the present embodiment, the heat-source-side expansion mechanism 24 is an electric expansion valve connected to the other end of the heat-source-side heat exchanger 23 for performing adjustment and the like of the flow rate of the refrigerant flowing in the heat-source-side refrigeration circuit 10*b*. One end of the heat-source-side expansion mechanism 24 is connected to the heat-source-side heat exchanger 23, and the other end is connected to the first closing valve 25.

The first closing valve 25 is a valve to which the first refrigerant communication pipe 6 is connected for exchanging refrigerant between the heat source unit 2 and the utilization unit 4, and the first closing valve 25 is connected to the heat-source-side expansion mechanism 24. The second closing valve 26 is a valve to which the second refrigerant communication pipe 7 is connected for exchanging refrigerant between the heat source unit 2 and the utilization unit 4, and the second closing valve 26 is connected to the switching mechanism 22. The first and second closing valves 25, 26 are three-way valves provided with a service port that can be communicated with the outside of the refrigerant circuit 10.

Various types of sensors are provided to the heat source unit 2. Specifically, a compressor discharge pressure sensor 28 for detecting a compressor discharge pressure Pd is provided to the discharge side of the compressor 21, and a heat-source-side heat exchanger temperature sensor 29 for detecting the cooler outlet refrigerant temperature Tco is provided to the outlet of the heat-source-side heat exchanger 23 in a case in which the heat-source-side heat exchanger 23 is made to function as a cooler of the refrigerant. In the present embodiment, the heat-source-side heat exchanger temperature sensor 29 is composed of a thermistor. The heat source unit 2 also has a heat-source-side control unit 30 for controlling the operation of the constituent components that constitute the heat source unit 2. The heat-source-side control unit 30 has a microcomputer, memory, and the like provided in order to control the heat source unit 2, and is configured so as to be capable of exchanging control signals and the like with the utilization-side control unit 44 of the utilization-unit 4 via the transmission line 8*a*.

<Refrigerant Communication Pipes>

The refrigerant communication pipes 6, 7 are refrigerant pipes that are constructed on-site when the air conditioning apparatus 1 is installed in the installation location thereof.

The utilization-side refrigerant circuit 10*a*, the heat-source-side refrigeration circuit 10*b*, and the refrigerant communication pipes 6, 7 are connected as described above to form the refrigerant circuit 10. In the air conditioning apparatus 1 of the present embodiment, a control unit 8 as a control means for controlling the various operations of the air conditioning apparatus 1 is formed by the utilization-side control unit 44, the heat-source-side control unit 30, and the transmission line 8*a* for forming a connection between the control units 30, 44. The control unit 8 is capable of receiving the detection signals and the like of the various sensors 29, 30, 43 and can control the various constituent components 21, 22, 24, 27, 42 on the basis of the detection signals and the like.

(2) Operation of the Air Conditioning Apparatus

Figure 2:
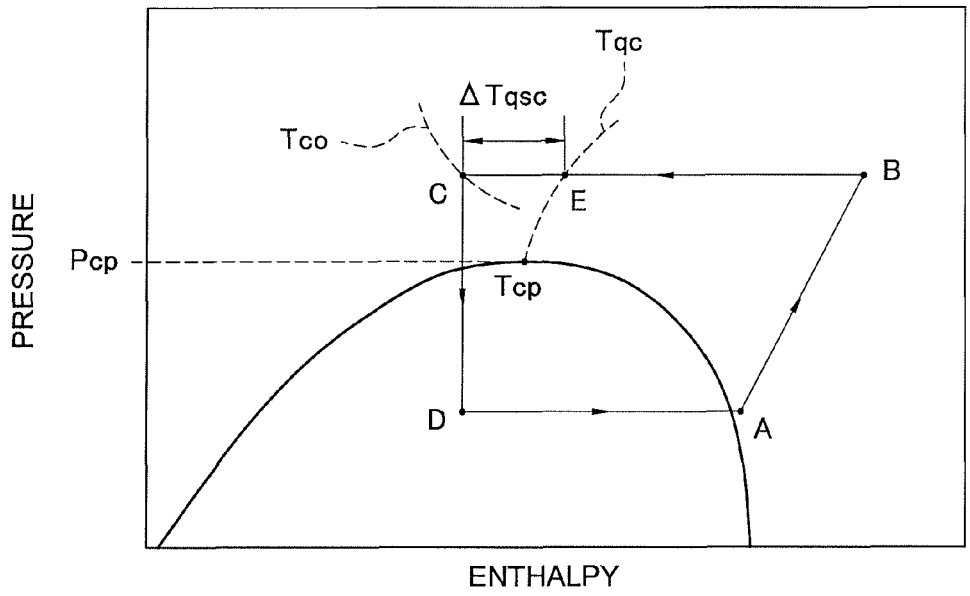
FIG. 2 is a pressure-enthalpy diagram showing the refrigeration cycle.

The operation of the air conditioning apparatus 1 of the present embodiment will next be described using FIGS. 1 and 2. FIG. 2 is a pressure-enthalpy diagram showing the refrigeration cycle in the present embodiment.

<Cooling>

During cooling, the switching mechanism 22 is in the state indicated by the solid line in FIG. 1; i.e., the switching mechanism 22 is in a state in which the discharge side of the compressor 21 is connected to the heat-source-side heat exchanger 23, and the intake side of the compressor 21 is connected to the second closing valve 26. The heat-source-side expansion mechanism 24 is configured so that the degree of opening thereof is adjusted. The closing valves 25, 26 are open.

In this state of the refrigerant circuit 10, when the compressor 21, the heat-source-side fan 27, and the utilization-side fan 42 are activated, the low-pressure refrigerant (see point A of FIG. 2) is sucked into the compressor 21 and compressed to a pressure that exceeds the critical pressure (i.e., Pcp in FIG. 2), and becomes high-pressure refrigerant (see point B of FIG. 2). The high-pressure refrigerant is then sent through the switching mechanism 22 to the heat-source-side heat exchanger 23 that functions as a cooler of the refrigerant, the high-pressure refrigerant is caused to exchange heat with the outside air supplied by the heat-source-side fan 27, and the refrigerant is cooled (see point C of FIG. 2). The high-pressure refrigerant cooled in the heat-source-side heat exchanger 23 is then reduced in pressure by the heat-source-side expansion mechanism 24 and become low-pressure refrigerant in a gas/liquid two-phase state (see point D in FIG. 2), and is sent through the first closing valve 25 and the first refrigerant communication pipe 6 to the utilization unit 4. This low-pressure refrigerant in a gas/liquid two-phase state that is sent to the utilization unit 4 is caused to exchange heat with indoor air and heated in the utilization-side heat exchanger 41 that functions as a heater of the refrigerant, and the refrigerant is thereby evaporated to become low-pressure refrigerant (see point A of FIG. 2). The low-pressure refrigerant heated in the utilization-side heat exchanger 41 is then sent through the second refrigerant communication pipe 7 to the heat source unit 2 and again sucked back into the compressor 21 through the second closing valve 26 and the switching mechanism 22. Cooling is thus performed.

During this cooling operation, a quasi-subcooling degree is controlled using the heat-source-side expansion mechanism 24. In this control of the quasi-subcooling degree, the degree of opening of the heat-source-side expansion mechanism 24 is adjusted so that the quasi-subcooling degree ΔTqsc, which is the temperature difference between a quasi-condensation temperature Tqc and the refrigerant temperature (i.e., the cooler outlet refrigerant temperature Tco detected by the heat-source-side heat exchanger temperature sensor 29) at the outlet of the heat-source-side heat exchanger 23, is within a predetermined temperature range, the quasi-condensation temperature Tqc being the refrigerant temperature at which the isobaric specific heat capacity of the refrigerant at the refrigerant pressure (herein, the compressor discharge pressure Pd detected by the compressor discharge pressure sensor 28, or a pressure calculated while taking into account the loss in pressure from the discharge side of the compressor 21 to the heat-source-side heat exchanger 23 on the basis of the compressor discharge pressure Pd) on the high-pressure side of the refrigeration cycle is at a maximum.

Figure 3:
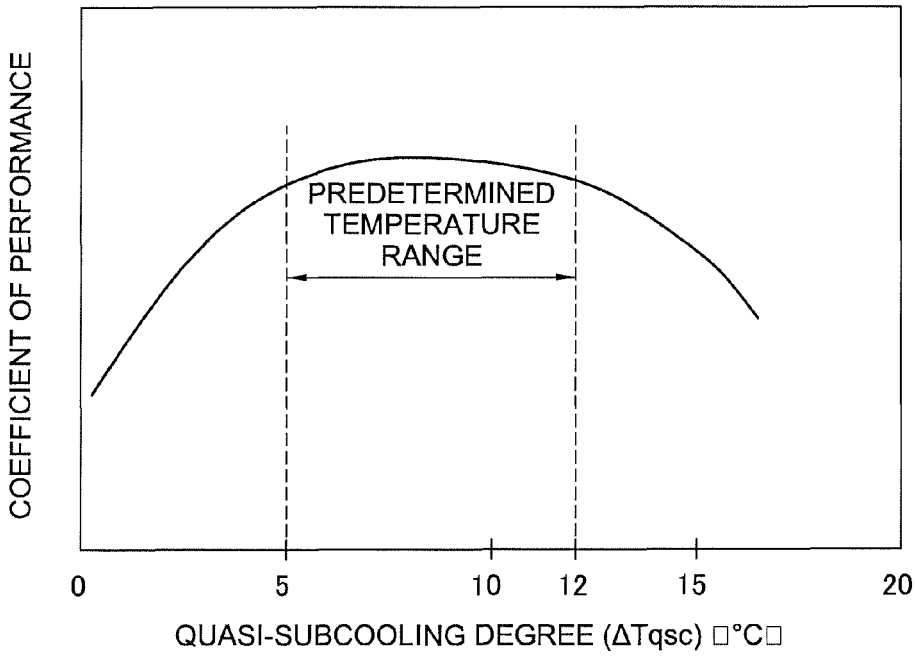
FIG. 3 is a diagram showing the relationship between the quasi-subcooling degree and the coefficient of performance.

The reason for performing control so that the quasi-subcooling degree ΔTqsc is within a predetermined temperature range will be described using FIGS. 1 through 3. FIG. 3 is a diagram showing the relationship between the quasi-subcooling degree ΔTqsc and the coefficient of performance.

In the refrigeration cycle operation repeated in the sequence of points A, B, C, D, and A shown in FIG. 2, when the cooler outlet refrigerant temperature Tco is given, there exists an optimum high-pressure-side refrigerant pressure where the coefficient of performance is near maximum.

However, when a range of refrigerant pressures on the high-pressure side where the coefficient of performance is near maximum is specified as a set value of the refrigerant pressure on the high-pressure side with respect to the cooler outlet refrigerant temperature Tco, and the degree of opening of the heat-source-side expansion mechanism 24 is controlled so that the refrigerant pressure on the high-pressure side conforms to the set value as in the conventional technique, the cooler outlet refrigerant temperature Tco changes, and this change is accompanied by a change in the refrigerant pressure range on the high-pressure side where the coefficient of performance is near maximum. The degree of opening of the heat-source-side expansion mechanism 24 must therefore be repeatedly controlled so that the refrigerant pressure reaches the set value of the refrigerant pressure on the high-pressure side after the change in the cooler outlet refrigerant temperature Tco, and it takes time for the coefficient of performance to approach the maximum value.

The inventors therefore investigated the range of refrigerant pressures on the high-pressure side with respect to the cooler outlet refrigerant temperature Tco, as well as controlled variables in the refrigeration cycle that are related to the coefficient of performance, and discovered that a correlation exists between the coefficient of performance and the quasi-subcooling degree ΔTqsc, as shown in FIG. 3. In other words, the inventors discovered that when a refrigeration cycle operation is performed in which the refrigerant pressure on the high-pressure side exceeds the critical pressure Pcp, the coefficient of performance hovers near the maximum thereof when the quasi-subcooling degree ΔTqsc, which is the degree of cooling from the quasi-condensation temperature Tqc, is kept within a predetermined temperature range, the quasi-condensation temperature Tqc being the refrigerant temperature at which the isobaric specific heat capacity of the refrigerant is at a maximum (see the dotted line passing through point E and the critical point Tcp in FIG. 2). The predetermined temperature range of the quasi-subcooling degree ΔTqsc is preferably a temperature range of 5° C. to 12° C., as shown in FIG. 3.

A control method is therefore employed in the refrigeration apparatus 1 of the present embodiment for using such information to control the quasi-subcooling degree ΔTqsc as a controlled variable so as to have a value within the predetermined temperature range.

The convergence of control can thereby be enhanced in comparison to the conventional control method in which the refrigerant pressure on the high-pressure side with respect to the cooler outlet refrigerant temperature Tco is controlled so as to conform to a set value. High-efficiency operation can therefore be rapidly achieved when the predetermined temperature range of the quasi-subcooling degree ΔTqsc is set to a temperature range in which the coefficient of performance is near maximum.

In the present embodiment, the quasi-subcooling degree is controlled using the heat-source-side expansion mechanism 24, and when the quasi-subcooling degree ΔTqsc is smaller than the minimum value (e.g., 5° C.) of the predetermined temperature range, the degree of opening of the heat-source-side expansion mechanism 24 is controllably reduced, and when the quasi-subcooling degree ΔTqsc is larger than the maximum value (e.g., 12° C.) of the predetermined temperature range, the degree of opening of the heat-source-side expansion mechanism 24 is controllably increased. Satisfactory responsiveness of control is therefore obtained.

<Heating>

During heating, the switching mechanism 22 is in the state indicated by the dashed line in FIG. 1; i.e., the switching mechanism 22 is in a state in which the discharge side of the compressor 21 is connected to the second closing valve 26, and the intake side of the compressor 21 is connected to the heat-source-side heat exchanger 23. The heat-source-side expansion mechanism 24 is configured so that the degree of opening thereof is adjusted. The closing valves 25, 26 are open.

In this state of the refrigerant circuit 10, when the compressor 21, the heat-source-side fan 27, and the utilization-side fan 42 are activated, the low-pressure refrigerant (see point A of FIG. 2) is sucked into the compressor 21, compressed to a pressure that exceeds the critical pressure (i.e., Pcp in FIG. 2), and become high-pressure refrigerant (see point B of FIG. 2). The high-pressure refrigerant is then sent through the switching mechanism 22, the second closing valve 26, and the second refrigerant communication pipe 7 to the utilization unit 4. The high-pressure refrigerant sent to the utilization unit 4 is caused to exchange heat with indoor air and cooled in the utilization-side heat exchanger 41 that functions as a cooler of the refrigerant (see point C of FIG. 2), and is then sent through the first refrigerant communication pipe 6 to the heat source unit 2. The high-pressure refrigerant sent to the heat source unit 2 is reduced in pressure by the heat-source-side expansion mechanism 24 and become low-pressure refrigerant in a gas/liquid two-phase state (see point D of FIG. 2), and flows into the heat-source-side heat exchanger 23 that functions as a heater of the refrigerant. The low-pressure refrigerant in a gas/liquid two-phase state that has flowed into the heat-source-side heat exchanger 23 is then evaporated and become low-pressure refrigerant by being heat-exchanged with outside air supplied by the heat-source-side fan 27 and by being heated by the outside air (see point A of FIG. 2), and the refrigerant is again sucked back into the compressor 21 through the switching mechanism 22. Heating is thereby performed.

During this heating operation, the quasi-subcooling degree is controlled using the heat-source-side expansion mechanism 24. This control of the quasi-subcooling degree during heating differs from control during cooling, in that the temperature difference between the quasi-condensation temperature Tqc and the refrigerant temperature at the outlet of the utilization-side heat exchanger 41 (i.e., the cooler outlet refrigerant temperature Tco detected by the utilization-side heat exchanger temperature sensor 43) is the quasi-subcooling degree ΔTqsc, but substantially the same control can be performed as during cooling. High-efficiency operation can thereby be rapidly achieved in the same manner as during cooling.

The control unit 8 (more specifically, the utilization-side control unit 44, the heat-source-side control unit 30, and the transmission line 8*a* for connecting the control units 30, 44) for functioning as an operation control means controls operation in cooling and heating, including controlling the quasi-subcooling degree.

(3) Other Embodiments

An embodiment of the present invention was described above based on the drawings, but the specific configuration of the present invention is not limited by the embodiment, and may be modified in a range that does not depart from the intended scope of the present invention.

(A)

In the embodiment described above, the heat-source-side expansion mechanism 24 was used as the constituent component for controlling the quasi-subcooling degree, but this configuration is not limiting. For example, the quasi-subcooling degree may be controlled using the compressor 21 by adjusting the operating capacity of the compressor 21. During cooling, the quasi-subcooling degree may be controlled using the heat-source-side fan 27 by adjusting the air flow rate of the heat-source-side fan 27. During heating, the quasi-subcooling degree may be controlled using the utilization-side fan 42 by adjusting the air flow rate of the utilization-side fan 42.

(B)

In the embodiment described above, the present invention was applied to a separate-type air conditioning apparatus 1 in which the utilization unit 4 was connected to the heat source unit 2 via the refrigerant communication pipes 6, 7, but this configuration is not limiting, and the present invention may be applied to various refrigeration apparatuses.

INDUSTRIAL APPLICABILITY

Through the use of the present invention, high-efficiency operation can be rapidly achieved in a refrigeration apparatus that performs a refrigeration cycle operation in which the high-pressure side attains a pressure that exceeds the critical pressure.

What is claimed is:

1. A refrigeration apparatus configured to perform a refrigeration cycle operation in which a high-pressure side attains a pressure that exceeds critical pressure of a refrigerant used in the refrigeration cycle operation, the refrigeration apparatus comprising:

a refrigerant circuit having a plurality of constituent components including a compressor, a cooler, an expansion mechanism, and a heater; and a control unit operatively coupled to control at least one of the constituent components such that a quasi-subcooling degree is within a predetermined temperature range, the quasi-subcooling degree being a temperature difference between a quasi-condensation temperature and a cooler outlet refrigerant temperature, with the quasi-condensation temperature being the refrigerant temperature at which isobaric specific heat capacity of the refrigerant at the refrigerant pressure on the high-pressure side of the refrigeration cycle is at a maximum.

2. The refrigeration apparatus according to claim 1, wherein the predetermined temperature range is set within a temperature range of 5° C. to 12° C.

3. The refrigeration apparatus according to claim 1, wherein the control unit controls the expansion mechanism such that the quasi-subcooling degree is within the predetermined temperature range.

4. The refrigeration apparatus according to claim 2, wherein the control unit controls the expansion mechanism such that the quasi-subcooling degree is within the predetermined temperature range.

* * * * *